United States Patent [19]

Austin, Jr.

[11] 4,005,885

[45] Feb. 1, 1977

[54] REMOTE CONTROLLED DOOR AND WINDOW

[76] Inventor: George K. Austin, Jr., P.O. Box 209, Rte. 2, Box 254, Newberg, Oreg. 97132

[22] Filed: Feb. 11, 1976

[21] Appl. No.: 657,145

[52] U.S. Cl. ..... 292/144; 70/264; 70/275

[51] Int. Cl.[2] ..... E05B 51/02

[58] Field of Search ..... 292/144, 177, 241, 201; 70/275, 264

[56] References Cited

UNITED STATES PATENTS

| | | | |
|---|---|---|---|
| 913,700 | 3/1909 | Cornman | 292/144 UX |
| 1,154,439 | 9/1915 | Scholfield | 292/144 |
| 3,624,761 | 11/1971 | Kohn | 292/144 X |
| 3,926,460 | 12/1975 | Peterson | 292/144 |

FOREIGN PATENTS OR APPLICATIONS

| | | | |
|---|---|---|---|
| 750,705 | 6/1956 | United Kingdom | 292/144 |

*Primary Examiner*—J. Franklin Foss
*Attorney, Agent, or Firm*—Klarquist, Sparkman, Campbell, Leigh, Hall & Whinston

[57] ABSTRACT

A lock mounted on a frame of a door or window by a U-shaped bracket includes an air cylinder attached to the bracket and adapted to be actuated by remote control to drive a dead bolt into a hole in the door or window. An electro-conductive pin carried by the bolt is moved between two contacts carried by the cylinder to light an indicator light at the remote control location, the cylinder being on electrical insulating material.

6 Claims, 5 Drawing Figures

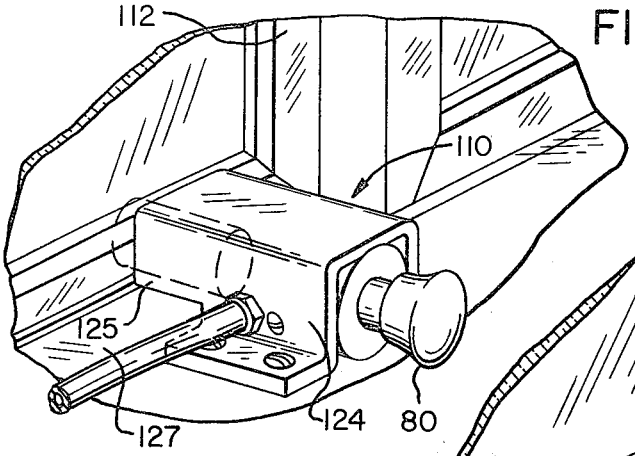
FIG. 5
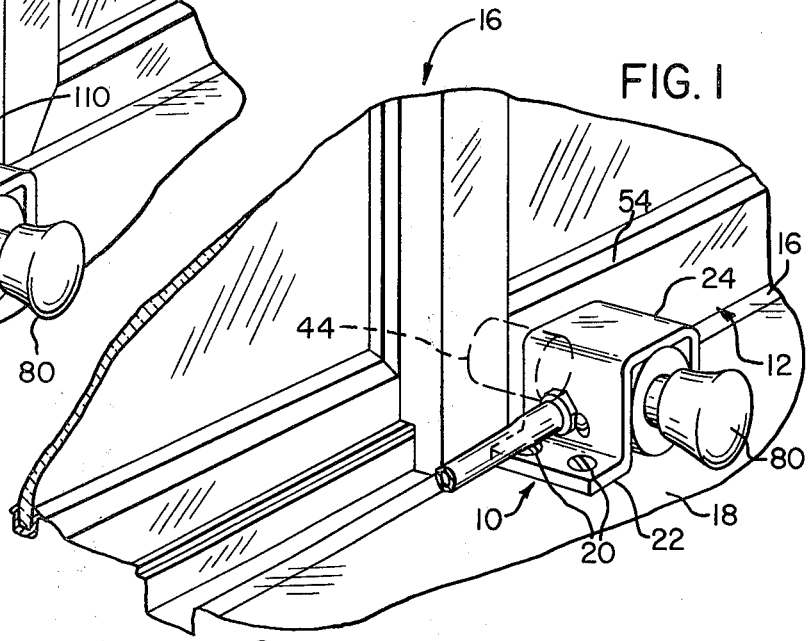
FIG. 1
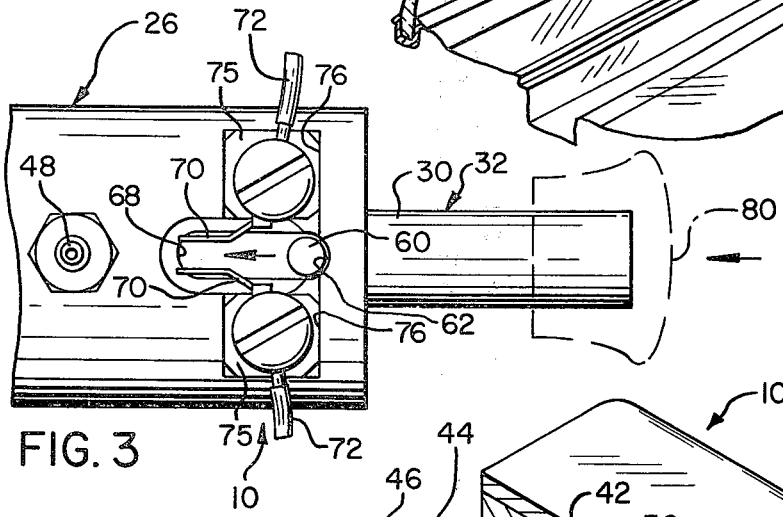
FIG. 3
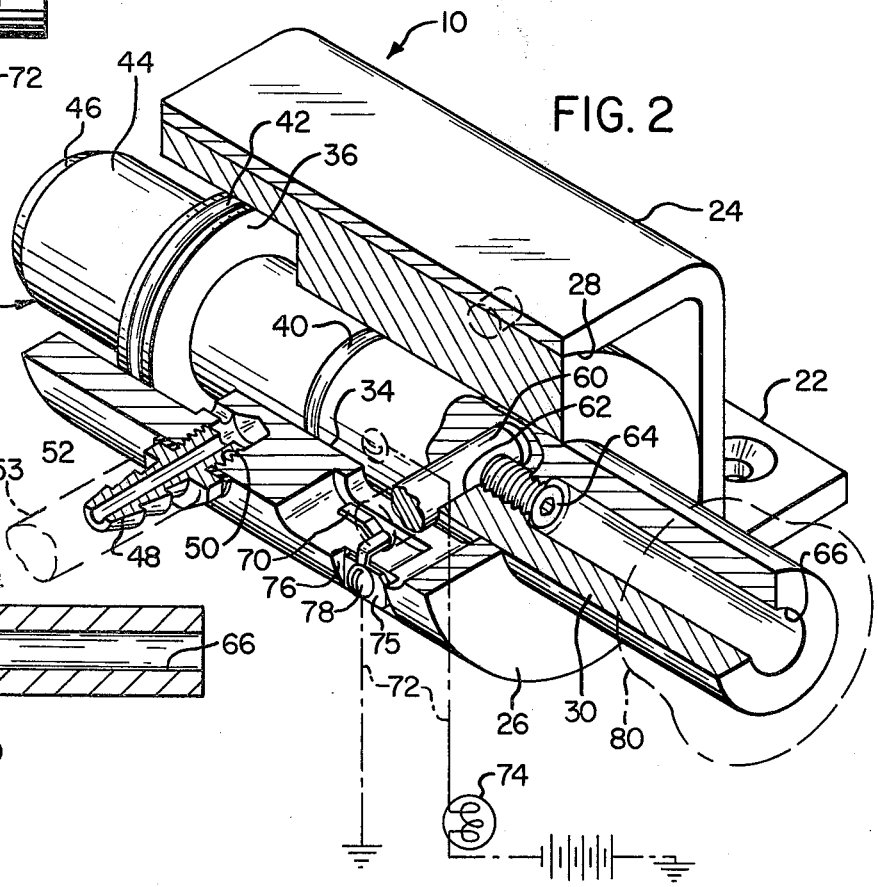
FIG. 2
FIG. 4
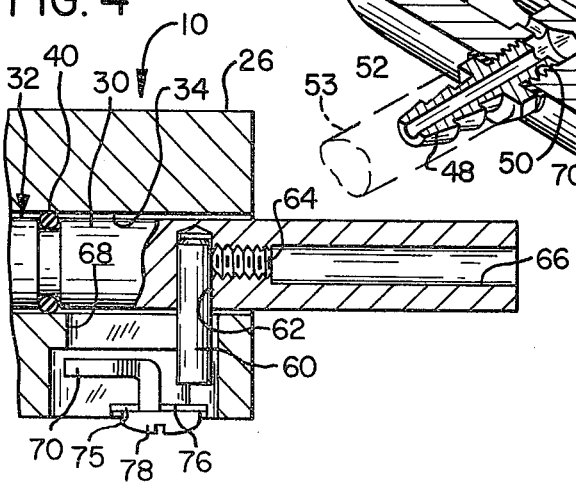

REMOTE CONTROLLED DOOR AND WINDOW

DESCRIPTION

This invention relates to remote controlled door and window locks, and has for an object thereof the provision of new and improved remote controlled door and window locks.

Another object of the invention is to provide a strong, easily installed door and window lock.

A further object of the invention is to provide a door and window lock which can be actuated by remote control and having a manual override.

Another object of the invention is to provide a lock including a cylinder fixed to a door or window casement by a U-shaped bracket with a piston having a dead bolt portion, a knob and a conductive pin adapted to bridge contacts carried by the cylinder to indicate when the dead bolt is in locking position.

In the drawings:

FIG. 1 is a fragmentary perspective view of a door construction and a remote control lock forming one embodiment of the invention;

FIG. 2 is an enlarged, partially sectional, perspective view of the lock of FIG. 1;

FIG. 3 is an enlarged, fragmentary, side elevation view of the lock of FIG. 1;

FIG. 4 is an enlarged, fragmentary, horizontal sectional view of the lock of FIG. 1; and FIG. 5 is a fragmentary, perspective view of a door construction and a remote control lock forming an alternate embodiment of the invention.

Referring now in detail to the drawings, there is shown in FIGS. 1 to 4 a remote controlled lock 10 of a lock system forming a specific embodiment of the invention and installed in a position locking an inside slide or door 12 of a door structure 14 in its closed position. The door structure includes a casement 16 and a floor or sill 18 to which the lock 10 is fixed by screws 20 passing through countersunk holes in flanges 22 of a U-shaped mounting bracket 24 preferably of an electrically insulating material of high strength, such as, for example, "DELRON". A cylinder 26 of similar, electrically insulating material fits closely in the U-shaped bracket with its sides contacting the inner faces of the legs of the bracket, the upper portion fitting in a shallow groove 28 (FIG. 2) in the top of the bracket and the bottom side of the cylinder substantially tangent to the plane of the bottom faces of the flanges.

A cylindrical shank 30 (FIG. 2) of a piston 32 is slidable in an axial bore 34 in the cylinder 26, and a piston portion 36 is slidable in counterbore 38. O-rings 40 and 42 carried by the shank and piston portion seal these members to the bore and counterbore. A dead bolt portion 44 extends forwardly from the piston portion and has a bevelled nose portion 46. A barb 48 is screwed into a tapped bore 50 leading to a port 52 opening into the bottom of the counterbore, and a hose 53 leads to a remotely controlled valve (not shown) in an air line and adapted when opened momentarily to give a pulse of air into the cylinder to drive the piston to the left, as viewed in FIG. 2, to drive the dead bolt into a hole in a frame 54 (FIG. 1) of the door slide 12 to lock the door slide in its closed position. After the pulse, the valve returns to is normal condition closing off the supply of air under pressure and connecting the cylinder to exhaust. However, the piston stays by friction in its locking position.

The piston 32 (FIG. 2) also carries a contact actuator 60 in the form of an electro-conductive pin locked in a transverse bore 62 by a set screw 64 at the bottom of a longitudinal bore 66 in the shank. The pin extends through a splining slot 68 in the cylinder 26, and, when the piston is moved from its unlocked position to its locked position, the pin is moved from a non-contacting position relative to spring contacts 70 to a closed position contacting both contacts 70 and bridging them electrically. The contacts are connected by a cord 72 to an indicating lamp 74 at the remote control location and, thus, when lit, indicates that the piston is in its locking position. The contacts have substantially rectangular mounting portions 75 (FIG. 3) rigidly fixed in complementary sockets 76 and having tapped bores into which connector screws 78 are screwed. A knob 80 is fixed to the shank 30 for manually pushing and pulling the piston to manually lock or unlock the door.

EMBODIMENT OF FIG. 5

A lock 110 for locking an outside slide or door 112 is identical to the lock 10 except that its bracket 124 has an overhanging or extension portion 125 and the dead bolt is longer so as to reach over casement sill portion 127.

What is claimed is:

1. In a remote controllable lock,
bracket means mountable on a casement frame,
a plunger having a dead bolt portion, and mounted movably on the bracket means,
motive means carried by the bracket means for moving the plunger between a locking position and an unlocking position,
the plunger having a handle portion adapted to be manually grasped for manually moving the plunger between its locked and unlocked positions,
the motive means comprising a piston on the plunger and a cylinder adapted to receive air under pressure,
indicator means,
and switch means fixed relative to the bracket means and operable by the plunger to indicate the position of the plunger,
the switch means including a pair of contacts mounted on the cylinder in spaced apart positions and electrically insulated from each other,
the switch means also including a conductive contactor carried by the plunger and movable by the plunger between a first position spaced from the contacts and a second position positioned between and contacting both the contacts.

2. The lock of claim 1 wherein the cylinder is of electrically insulating material.

3. The lock of claim 1 wherein the contactor is an electro-conductive rod projecting from one side of the plunger, and the cylinder has a splining slot through which the rod extends.

4. The lock of claim 3 wherein the cylinder has a bore and a counterbore, the piston being slidable in the counterbore and the plunger having a shank portion slidable in the bore and carrying the rod.

5. The lock of claim 4 wherein the cylinder is of electrically insulating material and the contacts are mounted directly thereon.

6. In a remote controllable lock,
bracket means mountable on a casement frame,
a plunger having a dead bolt portion, and mounted movably on the bracket means, and motive means carried by the bracket means for moving the plunger between a locking position and an unlocking position, the plunger having a handle portion adapted to be manually grasped for manually moving the plunger between its locked and unlocked positions, the motive means comprising a piston on the plunger and a cylinder adapted to receive air under pressure, the bracket means being a U-shaped bracket having flanged feet and fitting over and rigidly fixed to the cylinder, the cylinder extending longitudinally along and fitting into the bracket.

* * * * *